US006375158B1

(12) United States Patent
Krämer et al.

(10) Patent No.: US 6,375,158 B1
(45) Date of Patent: Apr. 23, 2002

(54) FASTENING DEVICE FOR CONNECTING A VALVE SPRING RETAINER TO A VALVE STEM

(75) Inventors: Johann Krämer, Leonberg; Jörg Rossow, Bretzfeld, both of (DE)

(73) Assignee: DaimlerChrysler A.G., Stuttgart (DE)

( * ) Notice: Subject to any disclaimer, the term of this patent is extended or adjusted under 35 U.S.C. 154(b) by 0 days.

(21) Appl. No.: 09/506,141

(22) Filed: Feb. 17, 2000

(30) Foreign Application Priority Data

Feb. 18, 1999 (DE) ..... 199 06 670
Aug. 6, 1999 (DE) ..... 199 37 147

(51) Int. Cl.[7] ..... F01L 3/10
(52) U.S. Cl. ..... 251/337; 251/336
(58) Field of Search ..... 251/337, 336

(56) References Cited

U.S. PATENT DOCUMENTS 1,840,704 A 1/1932 Dawson
2,633,111 A * 3/1953 Pielstick
3,265,053 A * 8/1966 Fitzsimons
3,939,484 A * 2/1976 Mueller ..... 123/90.67
4,180,030 A * 12/1979 McWhirter ..... 123/90.67
4,713,870 A * 12/1987 Szalvay ..... 29/402.09
4,838,218 A * 6/1989 Sato et al. ..... 123/188 AA
5,362,141 A * 11/1994 Beck et al. ..... 303/119.2

FOREIGN PATENT DOCUMENTS

DE 42 07 213 A1 9/1993
DE 198 10 465 C1 5/1999

* cited by examiner

*Primary Examiner*—Philippe Derakshani
*Assistant Examiner*—D. Austin Bonderer
(74) *Attorney, Agent, or Firm*—Klaus J. Bach

(57) ABSTRACT

A fastening device for connecting a valve spring retainer to a valve stem has a clamping sleeve, which acts radially on the valve stem and which blocks the valve spring retainer axially against the force of a valve spring on the valve stem, with the valve spring retainer being held displaceably on the valve stem.

In order to provide a fastening device between a valve spring retainer and a valve stem of an internal combustion engine that is functionally dependable over a long operating period and is easy to assemble and disassemble, it is provided that the valve stem has, at least in the region of the clamping sleeve, a continuous cylindrical circumferential surface and that the clamping sleeve consists of a shape memory alloy.

17 Claims, 3 Drawing Sheets

FASTENING DEVICE FOR CONNECTING A VALVE SPRING RETAINER TO A VALVE STEM

BACKGROUND OF THE INVENTION

1. Field of the Invention

The invention concerns a fastening device for connecting a valve spring retainer to a valve stem according to the precharacterizing clause of claim 1.

2. Description of the Related Art

The printed specification DE 42 07 213 A1 discloses a connection between the stem of a valve of an internal combustion engine and a valve spring retainer, which forms a support for a valve spring. The valve spring retainer, held on the valve stem, is secured against axial displacement on the valve stem by means of a sleeve-shaped clamping cone with a conical outer contour, in that the clamping cone is pushed onto the valve stem and inserted into a cylindrical, concentric receptacle of the spring retainer. The clamping cone is arranged on the side of the connection of the valve spring retainer and valve stem that is facing away from the valve spring; both the clamping cone and the valve spring retainer are held axially immovably on the valve stem in the clamping position of the clamping cone.

This fastening has the disadvantage that it is only possible with difficulty for the clamping cone to be released from the clamping position, because the conical outer contour of the clamping cone is seated in the receptacle of the spring retainer with high clamping force and there is the risk of material corrosion. Adjustment of the valve spring retainer, which may be required for example as a result of wear and is to be carried out after assembly, is made more difficult by this.

The invention is based on the problem of providing a fastening device between a valve spring retainer and a valve stem of an internal combustion engine that is functionally dependable over a long operating period and is easy to assemble and disassemble. The fastening device is in particular to be capable of being positioned with little expenditure of force steplessly on the valve stem. The fastening device is expediently to be capable of being loaded in both axial directions. The present invention is directed towards one or more of the problems set forth above.

The clamping sleeve which secures the valve spring retainer on the valve stem in a captive manner is held on the valve stem exclusively with non-positive engagement. This makes it possible to form the valve stem with an uninterrupted, continuous circumferential surface without grooves or projections, whereby on the one hand any weakening of the valve stem is avoided, so that the valve stem can in particular transfer higher axial forces, and on the other hand simpler and more cost-effective production of the valve stem is made possible. In addition, the assembly of the fastening device is simplified. Furthermore, the fastening device is of a small size.

The valve spring retainer can be adjusted steplessly on the valve stem and can be fastened on the valve stem in any axial position, whereby an exact positioning of the valve stem including the valve retainer is possible. The fastening device according to the invention is suitable in particular for electromagnetic valve controls in which an electromagnetic actuating means, acting on the valve stem, has to be adjusted in a mid-position between two magnets and it is necessary to compensate for any play, thermal expansions, wear etc. occurring.

A further advantage is that the advantageous material properties of the shape memory alloy can be used for establishing a secure connection. Shape memory alloys are distinguished in that their mechanical properties can be changed over a wide range by the influence of temperature or external stress. This effect can be used to provide a fastening with high clamping force which nevertheless can be released again at any time. Both the effect of the so-called suppressed shape memory and the effect of the superelasticity of the alloy can be utilized in particular. Nickel-titanium alloys, if appropriate also nickel-titanium-copper alloys, are used with preference. However, copper- or iron-based shape memory alloys may also be used.

In the case of the suppressed shape memory, the clamping sleeve, the internal diameter of which is smaller than the external diameter of the valve stem, is expanded plastically by mechanical action at a temperature at which a martensitic structure of a relatively soft consistency is formed, until unproblematical, essentially force-free pushing of the clamping sleeve over the valve stem is possible. Subsequently, a temperature increase above the switching temperature takes place, whereupon the clamping sleeve contracts due to transformation into an austenitic structure and has the tendency to revert to its original shape. For reasons of functional dependability, the transformation back from austenite to martensite should commence only at low temperatures, in order that the restoring force in the clamping sleeve in the form of a high radial stress is reliably available, to allow the valve spring retainer to be secured on the stem of the valve. This temperature requirement is met by cryogenic shape memory alloys. For releasing the connection, the clamping sleeve is cooled with liquid nitrogen or with other refrigerants, whereupon the softer martensitic structure forms again, the radial stress subsides and the clamping sleeve can be pulled off.

Shape memory alloys with an extended hysteresis may also be used. These have at room temperature a martensitic structure which is soft and easily deformable and can be expanded at room temperature. The clamping sleeve is pushed onto the valve stem at room temperature, in the expanded state, free from friction and forces and is subsequently heated to 165° C., whereby the structure is transformed into hard austenite. The clamping sleeve tries to revert to its original dimensions and thus builds up a radial stress, which holds the clamping sleeve on the valve stem with non-positive engagement. This stress only subsides again on transformation back from austenite to martensite, which in the case of shape memory alloys with an extended hysteresis does not take place until a temperature as low as −120 C.

Instead of the effect of the suppressed shape memory, the effect of the superelasticity may also be utilized. The superelasticity is distinguished by an elastic material behaviour up to approximately 8% elongation without any change in temperature. Expediently used as the material is likewise a shape memory alloy that is austenitic at room temperature, which is expanded for pushing onto the valve stem. As in the case of the suppressed shape memory, this connection is also released by cooling the clamping sleeve below the temperature at which the austenite has transformed completely into martensite.

In an advantageous development, the fastening device comprises a conical clamping part which is placed onto the valve stem and onto which the valve spring retainer is pushed. The clamping sleeve is pushed onto the stem on the side of the valve spring retainer that lies opposite from the valve spring, so that the valve spring presses the spring retainer against the clamping part and the clamping part is axially blocked by means of the clamping sleeve. In this configuration, it is sufficient to form the clamping sleeve as a simple clamping ring which is arranged on the axially outer end of the valve stem.

It may be expedient to form the clamping part and the clamping sleeve as a one-part, integral component from a shape memory alloy. This reduces the number of different parts and simplifies assembly and disassembly. In a development of the invention, the clamping sleeve is captively fastened on the valve spring retainer, in particular by welding, soldering etc. In addition, it may be appropriate to produce the entire valve spring retainer, including the clamping sleeve formed on it, from a shape memory alloy.

BRIEF DESCRIPTION OF THE DRAWINGS

Further advantages and expedient embodiments can be taken from the further claims, the description of the figures and the drawings, in which:

DETAILED DESCRIPTION OF THE INVENTION

Figure 1A:
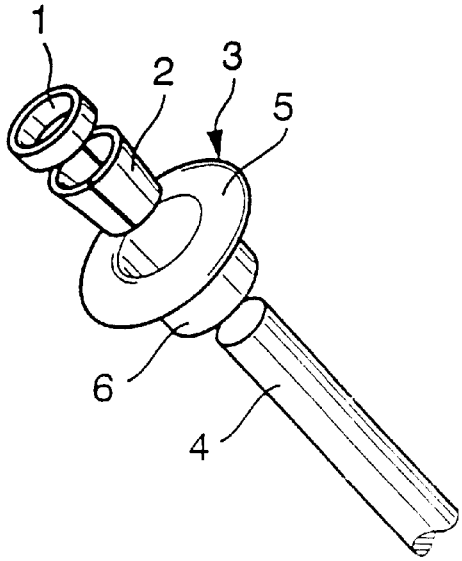
FIG. 1*a* to FIG. 1*d* show a first exemplary embodiment with a valve spring retainer, clamping part and clamping sleeve, represented in various assembly positions.
Figure 1B:
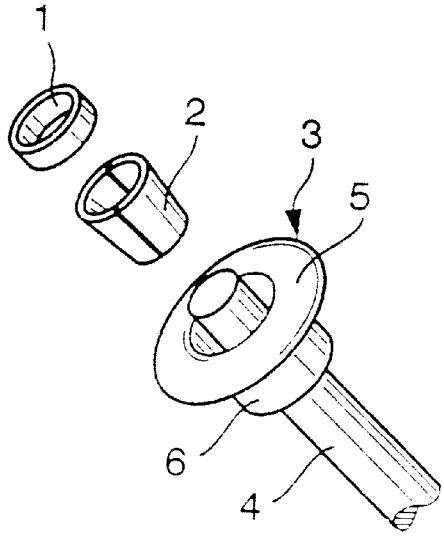
Figure 1C:
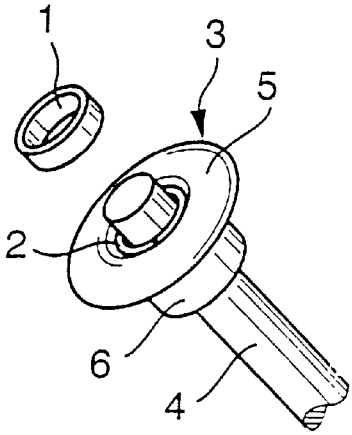
Figure 1D:
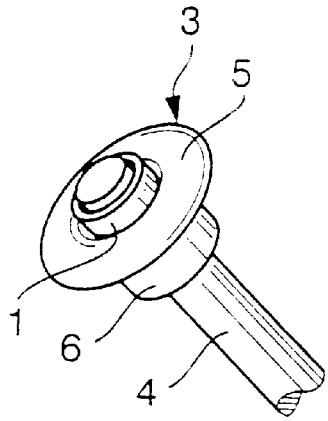

In the exemplary embodiments represented in FIGS. 1*a* to 4*b*, the same components are provided with the same reference numerals. In all the exemplary embodiments, the connection between a valve stem of an inlet or outlet valve and a valve spring retainer for an internal combustion engine is represented.

In the first exemplary embodiment, shown in FIGS. 1*a* to 1*d*, the fastening device for the connection of the valve stem 4 and valve spring retainer 3 comprises a clamping sleeve 1 and a clamping part 2. The clamping sleeve 1 is designed in the exemplary embodiment as a clamping ring and consists of a shape memory alloy.

The clamping part 2 has a conical circumferential surface, the smallest radius of which is slightly smaller and the greatest radius of which is greater than the radius of the cylindrical inner circumferential surface of the receiving opening of the valve spring retainer 3, so that the valve spring retainer 3 can be pushed onto the clamping part 2 and firmly clamped. The clamping part 2 comprises two separate halves, which are put together to form a unitary sleeve-shaped component and inserted into the receiving opening in the valve spring retainer 3. On account of the division into two halves, the clamping part has a radial elasticity.

The valve spring retainer 3 comprises a radially expanded supporting plate 5 for supporting a valve spring, which acts on the valve, and a guiding sleeve 6 which is of an approximately cylindrical form and has an internal diameter which is slightly greater than the diameter of the valve stem 4 and consequently permits a virtually friction-free sliding of the valve spring retainer 3 on the valve stem 4. The valve spring retainer 3 is formed as one part with the supporting plate 5 and the guiding sleeve 6. The circumferential surface of the valve stem 4 is of a cylindrical form throughout and has no interruptions in the form of radially set-back grooves or radial elevations, so that the valve spring retainer can slide on the valve stem without hindrance.

It may possibly also be expedient to provide the valve spring retainer 3, at least in the region of the supporting plate 5, with an inner cone adapted to the clamping part 2, so that there is surface-area contact of the inner cone against the circumferential surface of the clamping part with optimum, immovable and uncanted seating.

As the assembly sequence of FIGS. 1*a* to 1*d* reveals, first of all the valve spring retainer 3 is pushed onto the valve stem 4, then the conical clamping part 2 is inserted with the smaller radius ahead into the clearance in the valve spring retainer 3 and finally the clamping sleeve 1 is fitted on as a terminating component on the side that is adjacent to the axial end face of the valve stem 4 or facing away from the valve spring. The clamping sleeve produced from a shape memory alloy either has cryogenic properties or consists of an austenitic structure at room temperature, with the clamping sleeve initially being transformed into martensite and expanded before it is pushed onto the valve stem, and is subsequently converted into harder austenite with a high clamping stress on the valve stem. The valve spring retainer 3 and the clamping part 2 are held on the valve stem 4 exclusively by means of the clamping sleeve 1, which is fastened on the valve stem with non-positive engagement by means of a clamping force directed radially inwards.

Figure 2A:
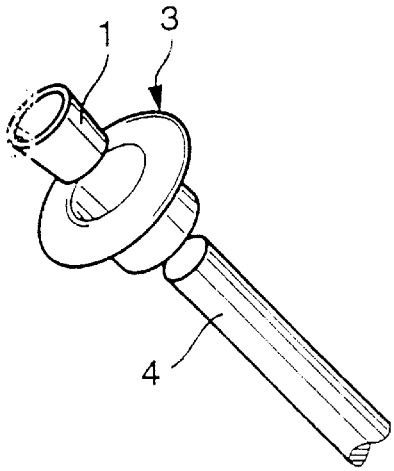
FIG. 2*a* to FIG. 2*c* show a second exemplary embodiment with a clamping part and clamping sleeve combined as one component.
Figure 2B:
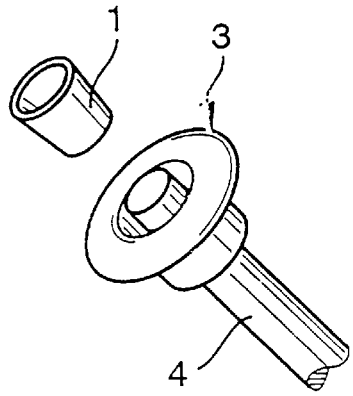
Figure 2C:
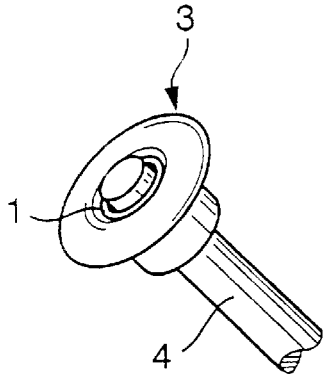

In the second exemplary embodiment, shown in FIGS. 2*a* to 2*c*, the clamping sleeve 1 is formed at the same time as a clamping part; the clamping sleeve 1 and the clamping part form a unitary component which is produced from a shape memory alloy. The circumferential surface of the clamping sleeve is conically shaped; in the assembly position, the clamping sleeve 1 is inserted into the receiving opening in the valve spring retainer 3 and blocks the latter in the axial direction.

Figure 3A:
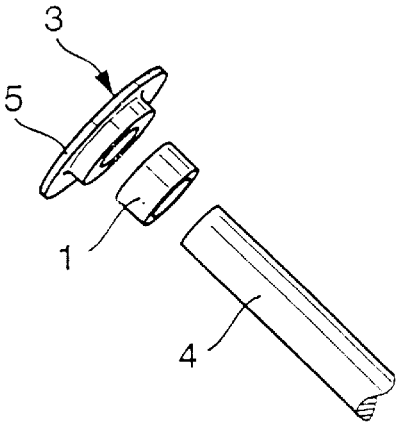
FIG. 3*a* to FIG. 3*c* show a third exemplary embodiment with a simplified spring retainer and with a clamping sleeve.
Figure 3B:
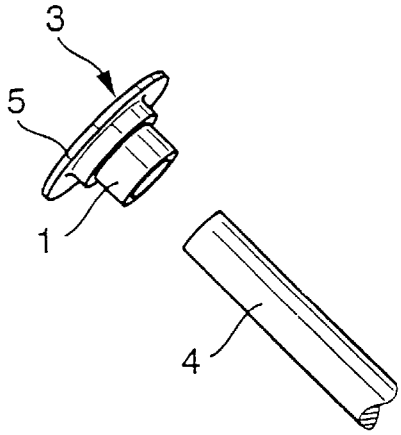
Figure 3C:
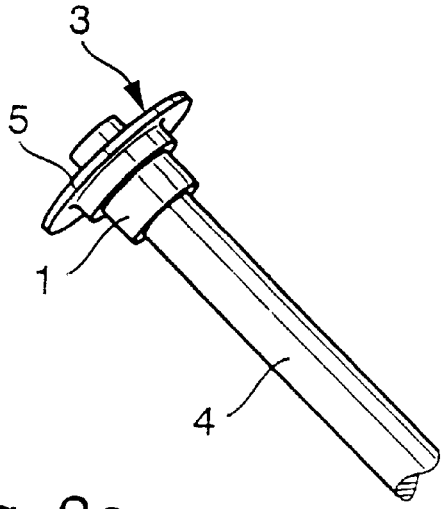

According to FIGS. 3*a* to 3*c*, the valve spring retainer 3 has only an approximately disc-shaped supporting plate 5 and a short pipe socket, but no guiding sleeve for guiding the spring retainer on the valve stem 4. The clamping sleeve 1 expediently has a cylindrical circumferential surface with a diameter adapted to the receiving opening of the valve spring retainer 3. In assembly, the clamping sleeve 1 is inserted into the receiving opening of the spring retainer 3 and firmly connected to the latter with the aid of a suitable fastening method, in particular by friction welding, laser-beam welding, brazing or the like. The assembly comprising the valve spring retainer 3 and clamping sleeve 1 is cooled to sub-zero temperatures—if using an alloy which has an austenitic structure at room temperature—and is expanded and positioned on the valve stem 4. With increasing temperature, the clamping sleeve 1 attempts to revert to its original state with a smaller radius, whereby the radial clamping force is produced. In this exemplary embodiment, the clamping sleeve has a relatively long axial dimension, so that the clamping sleeve can slide on the valve stem with good guidance; in addition to the fastening purpose, the clamping sleeve additionally undertakes the tasks of the guiding sleeve.

Figure 4A:
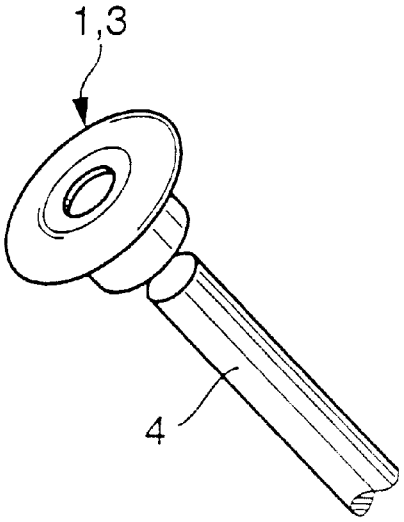
FIGS. 4*a*, 4*b* show a fourth exemplary embodiment with a spring retainer and clamping sleeve combined as one component.
Figure 4B:
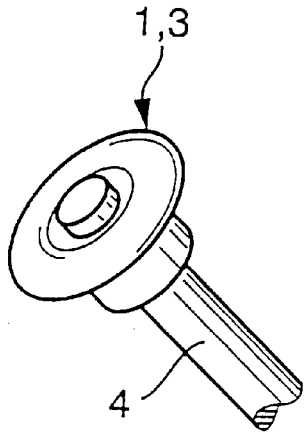

According to FIGS. 4*a*, 4*b*, the clamping sleeve 1 and the valve spring retainer 3 are combined as a unitary component made of a shape memory alloy, which is positioned and arrested on the valve stem 4. This configuration is distinguished by the simplest assembly, since only one component is required for the fastening device.

What is claimed is:

1. A fastening device for connecting a valve spring retainer to a valve stem with a constant diameter comprising:

a clamping sleeve consisting of a shape memory alloy, disposed on, and engaging, said valve stem radially on said constant diameter of said valve stem and supporting said valve spring retainer axially against the force of a valve spring acting on said valve spring retainer, said valve spring retainer being firmly supported by said clamping sleeve, but being held displaceably along the length of the valve stem due to the shape memory characteristics of the clamping sleeve.

2. A fastening device, as set forth in claim 1, wherein a clamping structure axially arresting the valve spring retainer is arranged on the valve stem and the clamping sleeve is held on the valve stem adjacent to said clamping structure for blocking the clamping structure on the side of the valve spring retainer facing away from the valve spring.

3. A fastening device, as set forth in claim 2, wherein said clamping structure and said clamping sleeve form a one-part component.

4. A fastening device, as set forth in claim 1, wherein the valve spring retainer has a radially expanded supporting plate for supporting the valve spring.

5. A fastening device, as set forth in claim 4, wherein the valve spring retainer has a cylindrical guidig sleeve extending from the radially expanded supporting plate.

6. A fastening device, as set forth in claim 5, wherein the guiding sleeve is formed as one part with the supporting plate.

7. A fastening device, as set forth in claim 6, wherein the supporting plate and the guiding sleeve forming the one-part component are made of a shape memory alloy.

8. A fastening device, as set forth in claim 5, wherein the guiding sleeve and the supporting plate are formed as two parts.

9. A fastening device, as set forth in claim 1, wherein the clamping sleeve consists of a nickel-titanium alloy.

10. A fastening device, as set forth in claim 1, wherein the clamping sleeve consists of a shape memory alloy with extended hysteresis.

11. A fastening device, as set forth in claim 1, wherein the clamping sleeve consists of a shape memory alloy that is austenitic at operating temperature.

12. A fastening device, as set forth in claim 1, wherein the clamping sleeve consists of a copper-based alloy.

13. The fastening device of claim 12, wherein the clamping sleeve is connected to the tubular socket with a connection selected from the group consisting of friction weld, laser-beam weld, brazed connection.

14. A fastening device, as set forth in claim 1, wherein the clamping sleeve consists of an iron-based alloy.

15. A fastening device, as set forth in claim 1, wherein the clamping sleeve is produced from a shape memory alloy by sintering.

16. A fastening device for connecting a valve spring retainer to a valve stem having a constant diameter comprising:

a one-part component made of a shape memory alloy and having a clamping sleeve portion which acts radially on said constant diameter of the valve stem and a valve spring retainer portion having a radially expanded supporting plate, said one-part component being firmly engaged with said valve stem, but being position adjustable along the length of the valve stem due to the shape memory characteristics of one-part component.

17. A fastening device for connecting a valve spring retainer to a valve stem having a constant diameter comprising:

a valve spring retainer having a disk shaped supporting plate for supporting the valve spring and a tubular socket extending from the disk shaped supporting plate; and a clamping sleeve connected to the tubular socket consisting of a shape memory alloy which acts radially on said constant diameter of the valve stem for fixing the position of a valve spring retainer against the force of a valve spring on the valve spring retainer, the clamping sleeve having an axial length sufficient for providing guidance for positioning the clamping sleeve and valve spring retainer on the valve stem.

* * * * *